United States Patent [19]

Desnick

[11] 4,228,834

[45] Oct. 21, 1980

[54] SOAP BAG

[76] Inventor: Shirley Desnick, 2540 Monterey Ave., Minneapolis, Minn. 55426

[21] Appl. No.: 71,745

[22] Filed: Aug. 30, 1979

[51] Int. Cl.[3] ..... A47K 7/03

[52] U.S. Cl. ..... 150/3; 401/201

[58] Field of Search ..... 150/3, 1; 401/201

[56] References Cited

U.S. PATENT DOCUMENTS

| | | | |
|---|---|---|---|
| 1,906,500 | 5/1933 | Twitchell | 150/1 |
| 2,163,324 | 6/1939 | Reinhold | 150/1 |
| 2,817,865 | 12/1957 | Arioli | 401/201 |
| 2,958,885 | 11/1960 | Donney | 401/201 X |
| 3,167,805 | 2/1965 | Zuppinger | 401/201 |
| 3,826,296 | 7/1974 | Morris | 150/3 |

*Primary Examiner*—Donald F. Norton

[57] ABSTRACT

A strip of plastic mesh fabric in a hexagonal pattern is folded together to provide front and rear portions and a continuous bottom, the side edges being folded inwardly and stitched to a narrow strip of fabric disposed therebetween. The upper edge of the mesh fabric is folded inwardly and downwardly, and stitched to a fabric band running around the mouth of the bag, the bag having Velcro fasteners for closing. One of the narrow strips has a loop segment for easy attachment to a strap.

5 Claims, 5 Drawing Figures

21
22
19
18
17
29
25
23
16
12
31
33
32
S
S
11
24
13
B
B
14
28
26
27

SOAP BAG

BACKGROUND OF THE INVENTION

This invention relates to a holder for hand soap, and, more particularly, to a portable non-slip soap bag for use in the bath or shower.

Bathers have long used soap dishes set into bathroom shower stalls or adjacent tubs for keeping a bar of soap handy. Typically, a nearby rack or peg is used to hold the washcloth. This arrangement, although simple and inexpensive, yet has exhibited disadvantages. The soap dishes tend to become slimy from repeated use, and are difficult to clean. Washcloths often tend to be out of reach or unprovided for. Keeping a firm grip on the soap bar during the soaping process has also been a problem.

More recently, attempts have been made to provide soap bags for use both as washcloths and as portable soap receptacles. One such improved washcloth is disclosed in U.S. Pat. No. 2,817,865. Another type of soap dispensing bag is disclosed in U.S. Pat. No. 2,807,940. However, none of the presently available soap bags has provided an inexpensive and easily used combination washcloth and soap receptacle, primariiy because of the difficulty of achieving simplicity of construction, and also because of the use of inadequate mesh fabric.

SUMMARY OF THE INVENTION

In accordance with this invention there is provided a soap bag comprising a strip of plastic mesh fabric folded together to provide front and rear sections and a continuous bottom edge, narrow cloth strips stitched between inwardly extending flap portions of the front and rear mesh sections, a band of fabric stitched around the mouth of the bag to secure a folded over upper flap of the bag, Velcro fasteners to permit a temporary closing of the bag, and a strap secured to an upper end of one of the narrow strips. Preferably the mesh fabric has a hexagonal pattern formed by interwined plastic filaments.

It is a primary object of this invention to provide an inexpensively fabricated and easy to use combination of scrubber and hand soap dispenser.

It is another object of this invention to provide a soap bag formed of plastic mesh in a pattern that exhibits optimum scrubbing characteristics.

It is a further object of this invention to provide a soap bag that can be firmly held in a bath or shower while scrubbing and which can be hung by a strap on a convenient hook or peg.

DESCRIPTION OF THE PREFERRED EMBODIMENT

Figures 1, 2, 3, 4, 5:
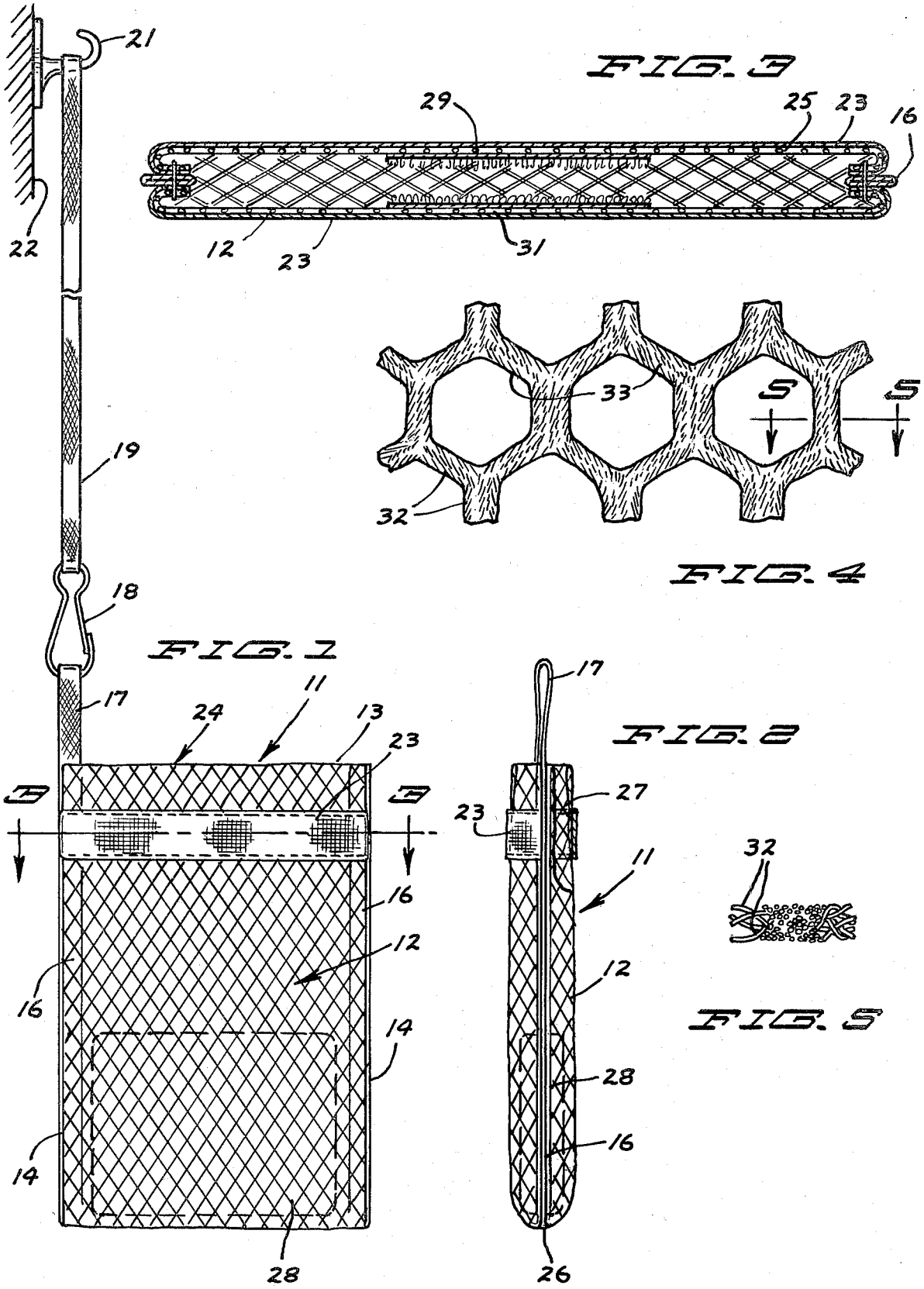
FIG. 1 is a front elevational view of the soap bag of this invention.
FIG. 2 is a partially broken away side elevational view of the soap bag of this invention.
FIG. 3 is a cross-sectional view taken along line 3—3 of FIG. 1.
FIG. 4 is an enlarged fragmentary view of the mesh pattern used in the soap bag of this invention.
FIG. 5 is an enlarged cross-sectional view taken along line 5—5 of FIG. 4.

Referring to FIG. 1, soap bag 11 has plastic mesh fabric front section 12, upper doubled over segment 13, side edges 14 having inwardly extending flaps 15 (as shown in FIG. 3) stitched to narrow cloth strips 16. One of the strips 16 has a loop segment 17 for attachment by metal clip 18 to strap 19, shown partially broken away.

The opposite end of strap 19 can be conveniently looped over hook 21 secured by adhesive to bathroom wall 22.

Fabric band 23 is formed of two strips running around the outside of the bag mouth 24 and stitched together at the sides, as more clearly shown in FIG. 3. Fabric band 23 thereby secures the doubled over segment 13, and further serves as a label or an identification strip for inscription of the user's name.

As shown in FIG. 2, soap bag 11 is formed by folding together of a plastic mesh strip to provide a bag having front and rear sections 12, 25 and a continuous bottom 26. The sides are sealed by narrow strips 16. Flap 27 of doubled over segment 13 is stitched to the front and rear sections 12, 25, together with fabric band 23, to provide a complete enclosure for a bar of soap 28.

FIG. 3 shows more clearly the attachment of fabric band 23 to the narrow strips 16 at either side of the soap bag. The use of fabric band 23 as shown, together with the disclosed stitching arrangement, provides a soap bag with firm side seams and added strength along the mouth of the bag.

Velcro fastener strips 29, 31 are stitched to fabric band 23 from the inside of the soap bag. The Velcro strips permit easy opening and closing of the bag for removal or insertion of soap bars.

FIG. 4 shows the preferred pattern of the plastic mesh fabric used in the soap bag 11 of this invention. Plastic threads 32 are woven together in a hexagonal array, each hexagon side 33 being about an eighth or a quarter inch in length.

FIG. 5 shows in detail the plastic threads 32 making up the hexagonal mesh pattern discussed above. Preferably, a pair of plastic threads are interwined to make up the mesh network, this arrangement making for optimum strength and excellent scrubbing characteristics.

I claim:

1. A bag for hand soap comprising a strip of plastic mesh fabric folded together to provide front and rear sections, the sides having inwardly extending flap portions, and the upper edge having inwardly and downwardly extending flap portions, a pair of narrow strips disposed between the inwardly extending flap portions of the front and rear sections, and stitched to such inwardly extending portions to provide a bag having a bottom and closed sides, one of the strips having a loop segment extending above the mouth of the bag, a band of fabric running around the mouth of the bag at a point down from the top thereof, the band being stitched to the front and rear sections of the mesh fabric and also to the inwardly and downwardly extending flap thereof, a Velcro fastener stitched to the fabric band within the mouth of the bag to allow temporary closing of the bag, and a strap secured to the loop segment of the narrow strip stitched to one side of the bag.

2. The soap bag of claim 1 wherein the mesh fabric is formed of interwined plastic threads to form a hexagonal mesh pattern.

3. The soap bag of claim 1 wherein the narrow side strips and the strap are formed of cotton.

4. The soap bag of claim 1 wherein the strap is secured to the loop segment by means of a clip.

5. The soap bag of claim 1 wherein the fabric band is of approximately one-half inch in width, to allow its use for labelling and name identification.

* * * * *